US005899368A

United States Patent [19]

Joulia

[11] Patent Number: 5,899,368

[45] Date of Patent: May 4, 1999

[54] CLOSURE AND DISPENSING CAP FOR A DISPENSER

[75] Inventor: Gerard Joulia, Paris, France

[73] Assignee: L'Oreal, Paris, France

[21] Appl. No.: 08/835,815

[22] Filed: Apr. 16, 1997

[30] Foreign Application Priority Data

Apr. 16, 1996 [FR] France ..... 96 04732

[51] Int. Cl.[6] ..... B67D 3/00

[52] U.S. Cl. ..... 222/507; 222/520

[58] Field of Search ..... 222/145.5, 145.7, 222/490, 520, 525, 502, 507

[56] References Cited

U.S. PATENT DOCUMENTS

| | | | |
|---|---|---|---|
| 2,135,237 | 11/1938 | Lewis et al. | 222/490 |
| 2,309,895 | 2/1943 | Griffith | 222/507 |
| 2,665,826 | 1/1954 | Mahoney | 222/520 |
| 2,901,152 | 8/1959 | Wahnsiedler | 222/507 |

FOREIGN PATENT DOCUMENTS

| | | |
|---|---|---|
| 968 868 | 12/1950 | France . |
| 2 054 784 | 7/1971 | France . |
| 213732 | 6/1941 | Germany . |
| 589 805 | 11/1933 | Netherlands . |

*Primary Examiner*—Philippe Derakshani
*Attorney, Agent, or Firm*—Oblon, Spivak, McClelland, Maier & Neustadt, P.C.

[57] ABSTRACT

A closure cap which adjusts the delivery, through a discharge passage, of at least one non-compact product contained in a container, including: a closure member which also adjusts the delivery of the product, made of an elastic material, which can be mechanically deformed in at least two directions, this member having passing through it a bore for dispensing the product, a stationary element, and an element which is movable in translation with respect to the stationary element, the stationary element and the moving element defining the discharge passage, the closure member being sandwiched between the stationary element and the moving element, an actuating mechanisms for bringing about the translational displacement of the moving element towards the stationary element. This displacement leads to progressive compression of the closure member in such a way that the passage is progressively closed by an elastic deformation of the said material.

30 Claims, 2 Drawing Sheets

CLOSURE AND DISPENSING CAP FOR A DISPENSER

BACKGROUND OF THE INVENTION

1. Field of the Invention

The present invention relates to a closure cap and/or a cap for adjusting the delivery of product and to a dispenser which includes a container of non-compact product and such a cap wherein the term "non-compact" is understood to mean a liquid, viscous, pasty or even powdered product.

2. Discussion of the Background

Such a closure cap which also adjusts delivery is especially appropriate for dispensing one or more widely used product(s) such as shampoo, toothpaste, hair-remover, body lotion, sunscreen, antiseptic, liquid make-up, or alternatively food products such as mayonnaise or mustard.

In general, cosmetic, dermopharmaceutical, food or body-care products of non-compact consistency are packaged in a container closed by a removable lid or by a dispensing cap equipped with a generally fliptop, closure member. To dispense the product the user removes the lid or opens the member which closes the cap. Caps which are opened by pulling and are known as "push-pull caps" are also known.

In the case of containers with a removable lid, it is possible to lose the lid. This then causes the product to become dried out or degraded by the ambient air. Furthermore, most closure caps commonly used do not allow a desired variation of the delivery with which the product is dispensed.

SUMMARY OF THE INVENTION

The object of the present invention is to provide a closure cap which also adjusts delivery and allows these drawbacks to be overcome.

More specifically, the present invention relates to a closure cap which also dispenses one or more products packaged in one and the same container which does not have a removable lid, it being possible for this product to be dispensed by the user simply by turning the cap.

The invention also relates to a cap for dispensing one or more products where the delivery of one or more products can be altered by the user as desired.

Thus the present invention provides a closure cap which also adjusts the delivery through a delivery passage of at least one non-compact product contained in a container, including:—a closure member which also adjusts the delivery of the product, is made of an elastic material, and can be mechanically deformed in at least two directions, this member having passing through it a bore for dispensing the product; a stationary element; and an element which can move in translation with respect to the stationary element, wherein the stationary element and the moving element define said delivery passage, the closure member is sandwiched between the stationary element and the moving element, and wherein actuating means are provided for bringing about the translational displacement of the moving element towards the stationary element to lead to progressive compression of the closure member in such a way that the bore is progressively closed by an elastic deformation of said elastic material. The cap is characterized in that closure of the delivery passage is brought about by a displacement of said elastic material at right angles to the axis of the cap in response to crushing of said material under the effect of an axial force exerted by the moving element on the closure member.

With the cap of the invention it is possible to adjust the delivery of one or more products depending on the user's requirements and on the nature of the products (low or high delivery).

Thus according to a first embodiment of the invention, the cap may be mounted on a container containing a single product. By turning the moving element the user can vary the cross section of the dispensing passage to suit the desired delivery of product and to suit the viscosity of the product. This arrangement also has the advantage that one and the same dispensing cap can be used for packaging and dispensing products of widely differing viscosity because, in general, a larger cross section of dispensing passage is required for dispensing a product of high viscosity than for dispensing a product of low viscosity. Thus just one type of packaging can be manufactured on an industrial scale irrespective of the product to be packaged.

According to a second embodiment, the cap may be used for dispensing a two-product compound. In this case, the cap comprises a hollow central duct situated inside the passage communicating with a first product, and defining a space communicating with a second product, these two products being housed in one and the same container, separated by an appropriate divider.

Such a two-product compound is, for example, a two-part toothpaste or alternatively any other two-part product requiring the parts to be stored separately, these parts having to be dispensed at the same time when the product is used.

Thus the first part may be a basic dermatological emulsion and the second a sunscreen concentrate. According to the invention, when dispensing this two-product compound, the user can vary the base emulsion/screen concentrate volumetric ratio to obtain a sunscreen composition with a variable sunscreen content. Thus the protective factor can be adjusted by the user as desired.

According to this second embodiment, the duct, the stationary element and the moving element preferably have a circular cross section and define an annular space surrounding the central duct. Thus the closure member is arranged in such a way that it can reduce or even seal off the said space as it is compressed, then radially deformed. Under these conditions, the central duct is in permanent communication with the first part of the product, the delivery of which is constant. The annular space is supplied with the second part of the product, the delivery of which can vary. It would also be possible to envisage a closure member which successively seals off the annular space and the central duct.

To make it easier to adjust the delivery it is possible to provide on the cap means of indexing the delivery of the second product, these means being situated on the stationary element and the moving element respectively. For example, in the case of the aforementioned sunscreen composition, the indexing means may indicate the protective factor corresponding to the volumetric proportion of the two parts dispensed.

When the cross section of the stationary element and of the moving element, as well as that of the closure member are circular, the stationary element advantageously includes a screw thread interacting with a complementary screw thread formed on the moving element, turning of the moving element with respect to the stationary element causing compression of the elastic member, this assembly constituting the actuating means. Of course other means of variable complementary fastening of the stationary element and of the moving element to ensure that they stay in a determined position may be envisaged, for example a system with notches.

The rotationally moving element is advantageously a cylindrical ring including a compression edge interacting with the elastic member.

The elastic material may be any material capable of converting an axial compression deformation into a radial deformation.

Advantageously, the elastic material is an elastomeric material chosen from the group of elastomers of polyethylene, polyurethane, polyester-polyether block amides; polyvinyls; ter-polymers of ethylene, propylene and a diene (EPDM); styrene-butadiene block copolymers (SEBSSIS), silicones, natural, or synthetic rubbers for example nitrile or polybutadiene rubber.

If appropriate, this elastomeric material may be in the form of closed-cell foam.

The elastic material advantageously has a Shore A hardness especially in the range from 20 to 80, and preferably a Shore A hardness of approximately 30.

The closure member made of this elastic material is advantageously in the form of a washer with a central bore. The central bore of this washer forms an integral part of the dispensing passage.

This washer may have an outside diameter and the orifice constituting the dispensing duct has an inside diameter which are such that the outside diameter/inside diameter ratio is preferably approximately 4. Advantageously, the washer has a thickness which is such that the inside diameter/thickness ratio is approximately 1.

BRIEF DESCRIPTION OF THE DRAWINGS

The description of two embodiments given hereafter by way of non-limiting illustration with reference to the appended drawings will make the invention easier to understand.

DESCRIPTION OF THE PREFERRED EMBODIMENTS

Figure 1:
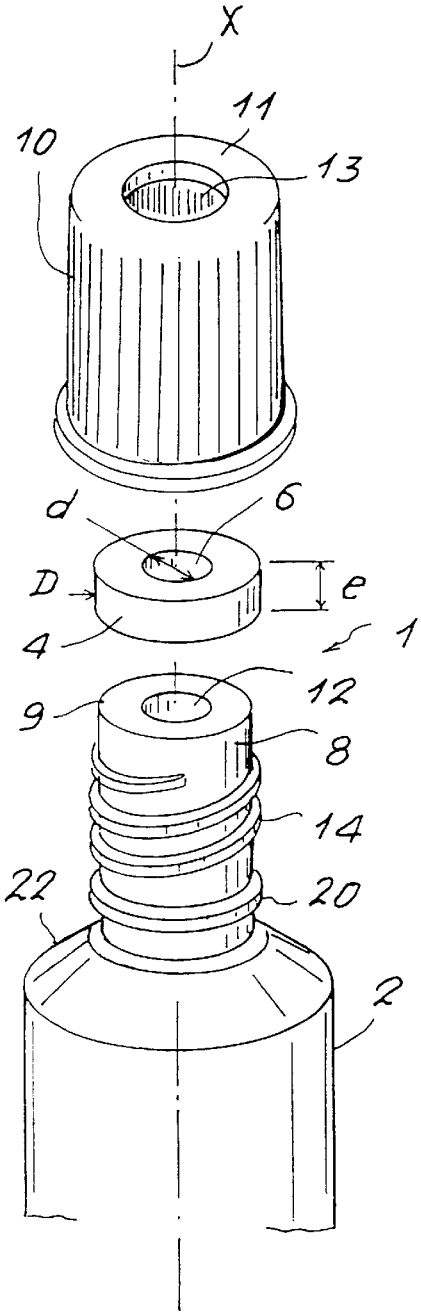
FIG. 1 represents an exploded elevation view of a closure cap which also regulates delivery, according to a first embodiment of the invention.
Figure 3:
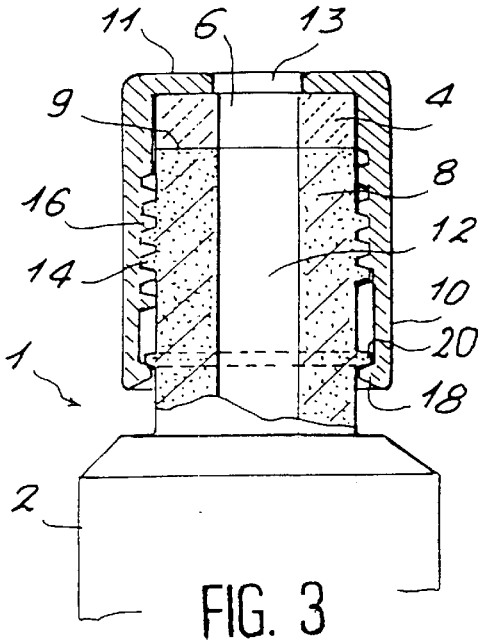
FIG. 3 represents an axial section taken through the cap of FIG. 1 mounted in an open position.
Figure 2:
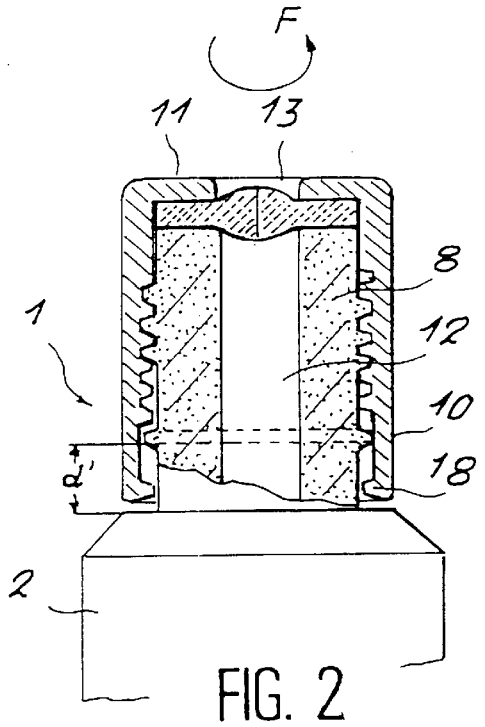
FIG. 2 represents an axial section taken through the cap of FIG. 1 mounted in a closed position.

With reference to FIGS. 1 to 3, it is possible to see a first embodiment of a cap in accordance with the invention, denoted overall by the reference 1.

Represented in these Figures is a container 2, made of flexible or semi-rigid material, including a cylindrical body closed by a closure cap 1 and having a longitudinal axis X. This body ends in a frustoconical shoulder 22 connected to a cylindrical neck 8 with a smaller diameter than that of the body of the container. The neck 8 constitutes a stationary element. This neck 8 has an external screw thread 14. The neck 8 defines a central internal passage 12 through which a product of liquid consistency contained in the container can flow out. Arranged between the screw thread 14 and the shoulder 22 is an annular catching lip 20, the purpose of which will be described hereinbelow.

The closure cap 1 comprises a washer 4 made of radially and axially deformable elastic material. In FIG. 3 this washer is represented in its initial shape. This washer is arranged on the free end 9 of the neck 8. It is made, for example, of polybutadiene rubber. This washer has substantially the same cross section as the neck 8. It includes a central dispensing bore 6 which can be sealed off, forming part of the central passage 12. The diameter of this bore is denoted d. The outside diameter D of the washer 4 is such that the ratio D/d is approximately 4. By way of example D equals 20 mm, d equals 5 mm, and the thickness e of the washer is approximately 5 mm. In the example under consideration, the container 2 has a volume of approximately 250 ml and, for example, contains hair shampoo.

The cap 1 additionally comprises a moving element 10 in the form of a cylindrical ring for adjusting the delivery, the top 11 of which constitutes an annular plate. This plate 11 has a central opening 13, which constitutes the orifice through which the product is dispensed. The washer 4 is sandwiched between the annular plate 11 and the end 9 of the neck 8. The cylindrical ring 10 has an internal screw thread 16 (see FIGS. 2 and 3) which complements the external screw thread 14 of the neck 8 and cooperates with the neck thread 14 to form actuating means ensuring axial compression of the washer 4. An internal annular flange 18 is provided on the lower edge of the ring 10, on the side pointing towards the container. It is intended to snap-fasten under the annular lip 20. The lip 20 is situated on the neck at a distance d' from the shoulder 22 so as to allow an axial displacement of the ring 10 in order to compress or decompress the washer 4. In addition, thanks to the presence of the flange 18/lip 20 assembly, the ring 10 cannot be accidentally unscrewed during use. The lip 20 limits the extent of unscrewing.

The cap 1 works as follows: During storage, the cap is in the position shown in FIG. 2. The ring 10 is screwed down, axially crushing the washer 4 so that the bore 6 is completely closed and the dispensing of product is impossible. When the user unscrews the ring 10 by turning, as indicated by the arrow F, this ring moves away from its initial position. At the end of unscrewing, the cap is in the position represented in FIG. 3. In this figure it can be seen that the elastic washer 4 has regained its original shape (see FIG. 1) and that the bore 6 is open. By inverting the container, product can therefore be dispensed.

It is possible to open the duct bore 6 to a lesser extent, by unscrewing the ring 10 only partially. Thus the user can better meter the delivery of product, and this is advantageous especially when the product has a low viscosity, such as a shampoo or hair lotion.

Figure 4:
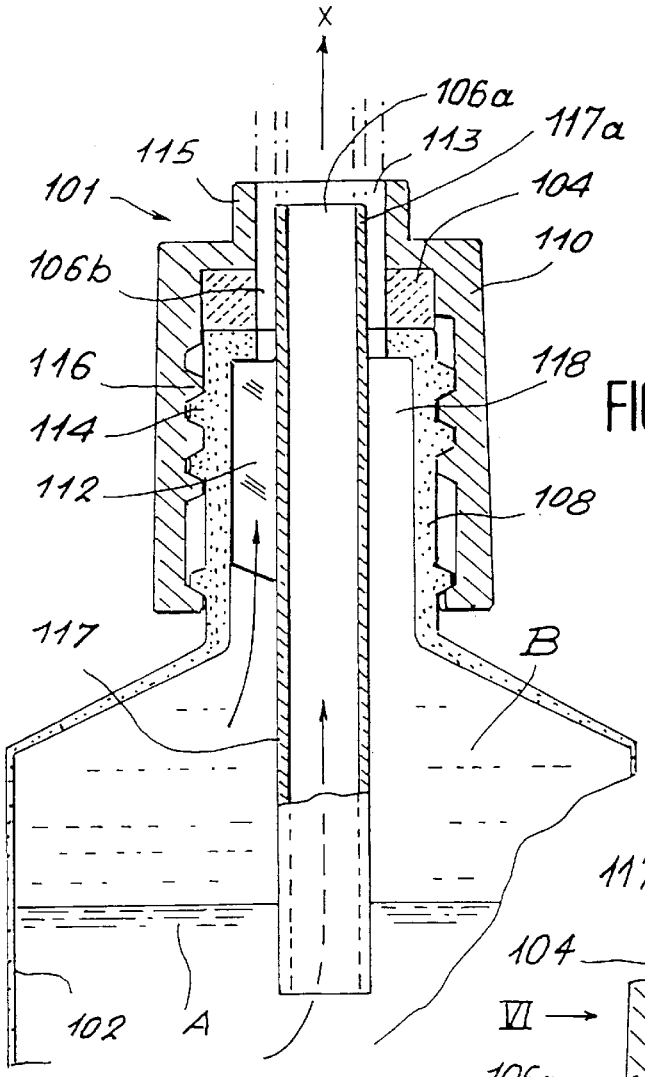
FIG. 4 represents an axial section for a second embodiment of a cap of the invention, this cap being used for simultaneously dispensing two different products, it being possible for an annular passage for dispensing one of the two products to be sealed off, at least in part.
Figure 6:
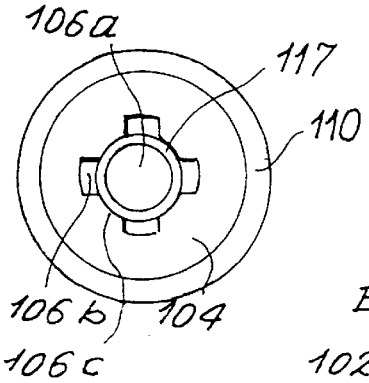
FIG. 6 shows a section through the elastic member on the plane VI—VI of FIG. 5 of the closure cap which also adjusts delivery.
Figure 5:
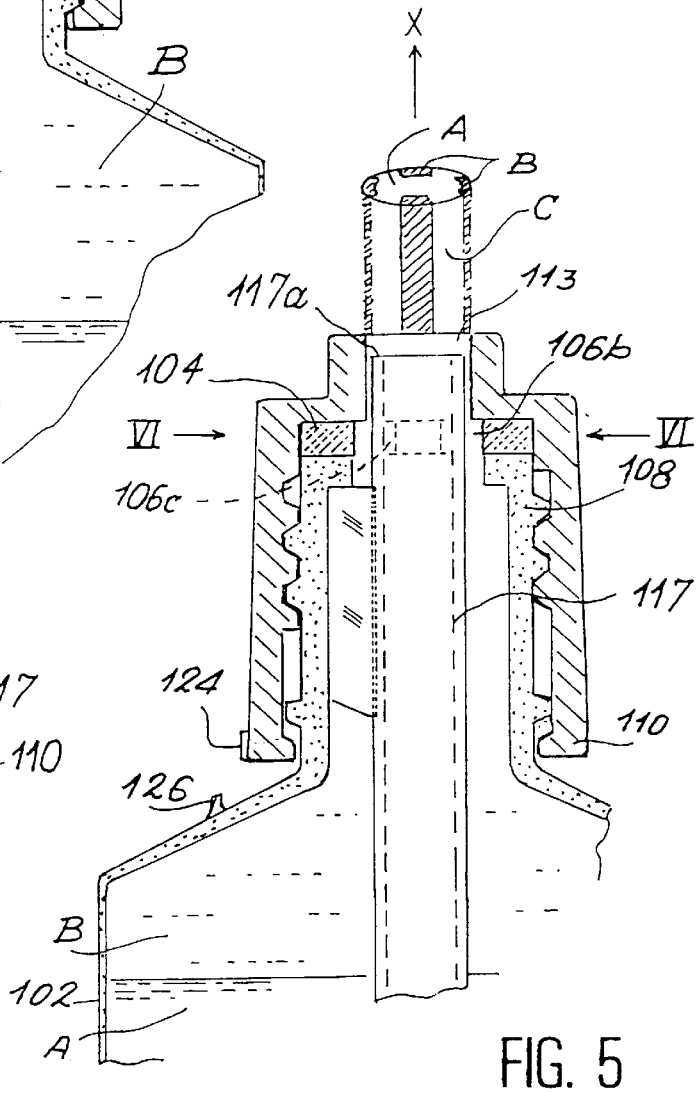
FIG. 5 shows the cap of FIG. 4, in which the passage for dispensing one of the two products is partially sealed off.

FIGS. 4 to 6 show a second embodiment of a cap 101 which can be used to dispense a two-part product. In these figures, the elements which are similar to those of FIGS. 1 to 3 or have a similar purpose carry the same reference numerals as FIGS. 1 to 3, increased by 100. They will be described again only in part.

FIGS. 4 and 5 show a container 102 equipped with a neck 108 and containing two parts A and B of pasty consistency, for example a toothpaste. The parts A and B are superimposed in such a way that the part B is close to the neck 108. The part A is therefore placed between the part B and the bottom of the container. On account of their high viscosity, the parts A and B do not mix. The cap 101 mounted on the container 102 is designed in such a way that the delivery at which the part B is dispensed can be varied.

For this, a tube 117 with a diameter markedly smaller than that of the neck 108 is arranged inside the neck 108 and constitutes a central duct 106*a*. The tube 117 protrudes slightly from the neck 108 of the container and extends towards the inside thereof, as far as a level situated just below the A/B interface. The tube 117 is held firmly in the neck 108 by a number of radial fins 112 defining an annular space 118 filled with the part B.

In a similar way to the first embodiment described hereinabove, the cap 101 comprises a washer 104 made of deformable material arranged on the neck 108 of the container and held in place by a delivery-adjusting ring 110. This ring 110 has a construction similar to that of the first embodiment, the only difference being that the dispensing orifice 113 has a skirt 115 extending outwards and surrounding the free end 117*a* of the tube 117. In a special embodiment of the washer 104, as represented in FIG. 6, the dispensing duct 106*a* has four uniformly-spaced radial cut-outs 106*b*.

The manner in which this embodiment of cap 101 works is illustrated in FIG. 5. By partially screwing the ring 110, the washer 104 is brought into a partially compressed condition. Thus its internal edges 106*c* are in contact with tube 117 and only the cut-outs 106*b* form passages for part B. Furthermore, the central duct 106*a* communicates with part A. By compressing the container 102, a string C of product comes out of the orifice 113, as illustrated in FIG. 5. This string C consists essentially of part A and contains four external longitudinal stripes formed of part B. By studying FIG. 5 it will be understood that the depth of the stripes B can be varied as a function of the degree of compression of the washer 104. Thus the part A/part B delivery ratio can be altered at will.

As may be seen in this FIG. 5, marks 124, 126 for indicating the ratio in which parts and B are delivered are provided respectively on the neck 122 of the container and on the ring 110.

Obviously, additional modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A closure cap which adjusts delivery through a delivery passage of at least one non-compact product contained in a container which comprises:

a closure member which also adjusts the delivery of the product, said closure being made of an elastic material, and being mechanically deformable in at least two directions, said closure member further having a bore passing therethrough for dispensing the product;

a stationary element, an element which is movable in translation with respect to the stationary element wherein the stationary element and the moving element define said delivery passage, the closure member being sandwiched between the stationary element and the moving element, and actuating means for bringing about translational displacement of the moving element towards the stationary element and for generating progressive compression of the closure member in such a way that the bore is progressively closed by an elastic deformation of said elastic material wherein closure of the delivery passage is brought about by displacement of said elastic material at right angles to the axis of the cap in response to crushing of said material under the effect of an axial force exerted by the moving element on the closure member.

2. A cap according to claim 1, wherein the actuating means for the stationary element and the moving element include a variable complementary fixing means for keeping the stationary element and moving element at a predetermined position with respect to one another.

3. A cap according to claim 2, wherein the variable complementary fixing means includes a screw thread formed on the stationary element interacting with a complementary screw thread formed on the moving element turning of the moving element with respect to the stationary element, causing compression of the elastic member, said actuating means comprising said fixing means.

4. A cap according to claim 1, wherein the elastic material comprises an elastomeric material.

5. A cap according to claim 1, wherein the elastic material has a Shore A hardness in the range from 20 to 80.

6. A cap according to claim 1, wherein the elastic material has a Shore A hardness of 30.

7. A cap according to claim 1, wherein the closure member comprises a washer.

8. A cap according to claim 7, wherein the washer has a first diameter and the duct a second diameter, the ratio of the first diameter to the second diameter being approximately 4.

9. A cap according to claim 8, wherein the washer has a thickness and the ratio of said thickness to the second diameter being approximately 1.

10. A cap according to claim 7, which comprises a hollow duct situated inside the passage communicating with a first product and defining a space communicating with a second product.

11. A cap according to claim 10, which comprises means for indexing the delivery of the second product, said means for indexing interacting with the stationary element and the moving element.

12. A cap according to claim 10, wherein the duct, the stationary element and the moving element have a circular cross section and define an annular space surrounding the duct.

13. A cap according to claim 7, wherein the closure member is arranged so as to seal off said space as said closure member is compressed.

14. A dispenser, which comprises:

a container containing at least one product to be dispensed and a closure cap which also adjusts delivery of said at least one product, said cap including a closure member which also adjusts the delivery of the product, said closure member being made of an elastic material and being mechanically deformable in at least two directions, said closure member further having a bore passing therethrough for dispensing the product;

a stationary element, and an element which is movable in translation with respect to the stationary element wherein the stationary element and the moving element define said delivery passage, the closure member being sandwiched between the stationary element and the moving element and actuating means for bringing about translational displacement of the moving element towards the stationary element and for generating progressive compression of the closure member in such a way that the bore is progressively closed by an elastic deformation of said elastic material wherein closure of the delivery passage is brought about by displacement of said elastic material at right angles to the axis of the cap in response to crushing of said material under the effect of an axial force exerted by the moving element on the closure member.

15. A dispenser according to claim 14, wherein the product comprises a cosmetic product.

16. A closure cap which adjusts delivery through a delivery passage of at least one non-compact product contained in a container which comprises:

a closure member which also adjusts the delivery of the product, said closure being made of an elastic material, and being mechanically deformable in at least two directions, said closure member further having a bore passing therethrough for dispensing the product;

a stationary element, an element which is movable in translation with respect to the stationary element wherein the stationary element and the moving element define said delivery passage, the closure member being sandwiched between the stationary element and the moving element, and an actuating mechanism bringing about translational displacement of the moving element towards the stationary element and generating progressive compression of the closure member in such a way that the bore is progressively closed by an elastic deformation of said elastic material wherein closure of the delivery passage is brought about by displacement of said elastic material at right angles to the axis of the cap in response to crushing of said material under the effect of an axial force exerted by the moving element on the closure member.

17. A cap according to claim 16, wherein the actuating mechanism includes a variable complementary fixing mechanism keeping the stationary element and moving element at a predetermined position with respect to one another.

18. A cap according to claim 17, wherein the variable complementary fixing mechanism includes a screw thread formed on the stationary element interacting with a complementary screw thread formed on the moving element turning of the moving element with respect to the stationary element, causing compression of the elastic member, said actuating mechanim comprising said fixing means.

19. A cap according to claim 16, wherein the elastic material comprises an elastomeric material.

20. A cap according to claim 16, wherein the elastic material has a Shore A hardness in the range from 20 to 80.

21. A cap according to claim 16, wherein the elastic material has a Shore A hardness of 30.

22. A cap according to claim 16, wherein the closure member comprises a washer.

23. A cap according to claim 22, wherein the washer has a first diameter and the duct a second diameter, the ratio of the first diameter to the second diameter being approximately 4.

24. A cap according to claim 23, wherein the washer has a thickness and the ratio of said thickness to the second diameter being approximately 1.

25. A cap according to claim 22, which comprises a hollow duct situated inside the passage communicating with a first product and defining a space communicating with a second product.

26. A cap according to claim 25, which comprises a mechanism indexing the delivery of the second product, said indexing mechanism interacting with the stationary element and the moving element.

27. A cap according to claim 25, wherein the duct, the stationary element and the moving element have a circular cross section and define an annular space surrounding the duct.

28. A cap according to claim 22, wherein the closure member is arranged so as to seal off said space as said closure member is compressed.

29. A dispenser, which comprises:

a container containing at least one product to be dispensed and a closure cap which also adjusts delivery of said at least one product, said cap including a closure member which also adjusts the delivery of the product, said closure member being made of an elastic material and being mechanically deformable in at least two directions, said closure member further having a bore passing therethrough for dispensing the product;

a stationary element, and an element which is movable in translation with respect to the stationary element wherein the stationary element and the moving element define said delivery passage, the closure member being sandwiched between the stationary element and the moving element and an actuating mechanism for bringing about translational displacement of the moving element towards the stationary element and generating progressive compression of the closure member in such a way that the bore is progressively closed by an elastic deformation of said elastic material wherein closure of the delivery passage is brought about by displacement of said elastic material at right angles to the axis of the cap in response to crushing of said material under the effect of an axial force exerted by the moving element on the closure member.

30. A dispenser according to claim 29, wherein the product comprises a cosmetic product.

* * * * *